US007648445B1

(12) United States Patent
Chen et al.

(10) Patent No.: US 7,648,445 B1
(45) Date of Patent: Jan. 19, 2010

(54) ELLIPTICAL EXERCISE APPARATUS

(75) Inventors: Chun-Ho Chen, Taichung (TW); Chia-Hsiun Chuang, Taichung (TW)

(73) Assignee: Cycling & Health Tech Industry R & D Center, Taichung (TW)

( * ) Notice: Subject to any disclaimer, the term of this patent is extended or adjusted under 35 U.S.C. 154(b) by 0 days.

(21) Appl. No.: 12/462,231

(22) Filed: Jul. 31, 2009

(51) Int. Cl.
*A63B 22/04* (2006.01)
*A63B 22/00* (2006.01)
*A63B 69/16* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS 5,295,927 A * 3/1994 Easley et al. ..... 482/52
5,536,225 A * 7/1996 Neuberg et al. ..... 482/71
6,855,093 B2 * 2/2005 Anderson et al. ..... 482/52
6,905,441 B2 * 6/2005 Anderson et al. ..... 482/52
6,949,054 B1 * 9/2005 Stearns et al. ..... 482/52
7,153,238 B2 * 12/2006 Anderson et al. ..... 482/52
7,226,391 B2 * 6/2007 Hsu ..... 482/52

* cited by examiner

*Primary Examiner*—Steve R Crow
(74) *Attorney, Agent, or Firm*—Charles E. Baxley

(57) ABSTRACT

An elliptical exercise apparatus includes a body having a base frame and two supporting frames uprighted at two opposite sides of the base frame; a pair of lead swing arms each having an upper end pivotally coupled with the corresponding supporting frame wherein a sliding treadle assembly having a lower end provided with a treadle portion is axially slidably attached to the lead swing arm; a pair of subsidiary swing arms each having one end pivotally coupled with the base frame wherein a subsidiary sliding sleeve pivotally coupled with the sliding treadle assembly via a pivot is axially slidably attached to the subsidiary swing arm; and a rotational shaft transversely and pivotally coupled with the base frame, wherein at each of two ends of the rotational shaft, a vertical rotational link has one end coupled with the rotational shaft and an opposite end pivotally coupled with the sliding sleeve.

12 Claims, 9 Drawing Sheets

ELLIPTICAL EXERCISE APPARATUS

BACKGROUND OF THE INVENTION

1. Technical Field

The present invention relates to exercise apparatuses, and more particularly, to an elliptical exercise apparatus that generates an elliptical exercising track to guide an elliptical exercise motion.

2. Description of Related Art

To modern people who live a busy life, it is important to keep healthy by taking exercise regularly. Thus, indoor exercise equipment is popular in both houses and fitness clubs for its availability and accessibility.

Since walking has been medically proven as a moderate and relaxing exercise suitable to average people, exercise equipment related thereto, such as fitness steppers and cross trainers, is taking a significant market share. While a stepper only facilitates a simple "mark time" movement of legs, a known cross trainer trains not only lower limbs, but also upper limbs, thus being multifunctional and more interesting to exercisers.

The conventional cross trainer preliminary comprises a frame mounted thereon a pair of handle-shafts swingable along the major length of the elliptical trainer. Each said handle-shaft has an upper end provided with a handle portion and a lower end coupled with a treadle. Thereby, the alternately swing handle-shafts guide an exerciser stepping on the treadles and holding the handle portions to perform in-place striding. However, the swing handle-shafts themselves can only perform simple pendulum-like swinging and thus only a limited range of exercisers' muscles can get trained by the conventional cross trainer. For the same reason, the exercise motion guided by the conventional cross trainer is still far from genuine human striding. Besides, two treadle-shafts of the conventional cross trainer are configured to move independent of each other and are prone to get interfered by the hands' operation. During exercise, when exercising with rapidness or under uncoordinated limb movements, an exerciser may have difficulty in keeping continuity and balance and thus risks getting muscle strains or falling down from the trainer.

SUMMARY OF THE INVENTION

The primary objective of the present invention is to provide an elliptical exercise apparatus that generates an elliptical or elliptical-like exercise track simulating human striding to train an increased range of human muscles, thus providing improved exercise effects, wherein the elliptical exercise apparatus guides two lower limbs of an exerciser thereon to move counter to each other so as to ensure a smooth and continuous striding exercise by preventing the exerciser's two feet from simultaneously moving forward or backward and prevent the exerciser from exercising with only one foot due to the exerciser's poor coordination.

To achieve these and other objectives of the present invention, the present invention provides an elliptical exercise apparatus that comprises:

a body having a base frame and two supporting frames uprighted at two opposite sides of the base frame;

a pair of lead swing arms each having an upper end pivotally coupled with the corresponding supporting frame wherein a sliding treadle assembly having a lower end provided with a treadle portion is axially slidably attached to the lead swing arm;

a pair of subsidiary swing arms each having one end pivotally coupled with the base frame wherein a subsidiary sliding sleeve pivotally coupled with the sliding treadle assembly via a pivot is axially slidably attached to the subsidiary swing arm; and a rotational shaft transversely and pivotally coupled with the base frame, wherein at each of two ends of the rotational shaft, a vertical rotational link has one end coupled with the rotational shaft and an opposite end pivotally coupled with a lower end of the sliding sleeve.

In operation, when an exerciser pushes on the treadle portions, the lead swing arms and the subsidiary swing arms respectively swing back and forth and the sliding sleeves as well as the subsidiary swing arms slide vertically along the lead swing arms and the subsidiary swing arms while the rotational link rotates against the rotational shaft. By the linked lead swing arms, subsidiary swing arms, sliding sleeves, subsidiary sliding sleeves, rotational shaft and rotational link, the treadle portions move along an elliptical exercise track.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawing, wherein.

DETAILED DESCRIPTION OF THE PREFERRED EMBODIMENT

Figure 1:
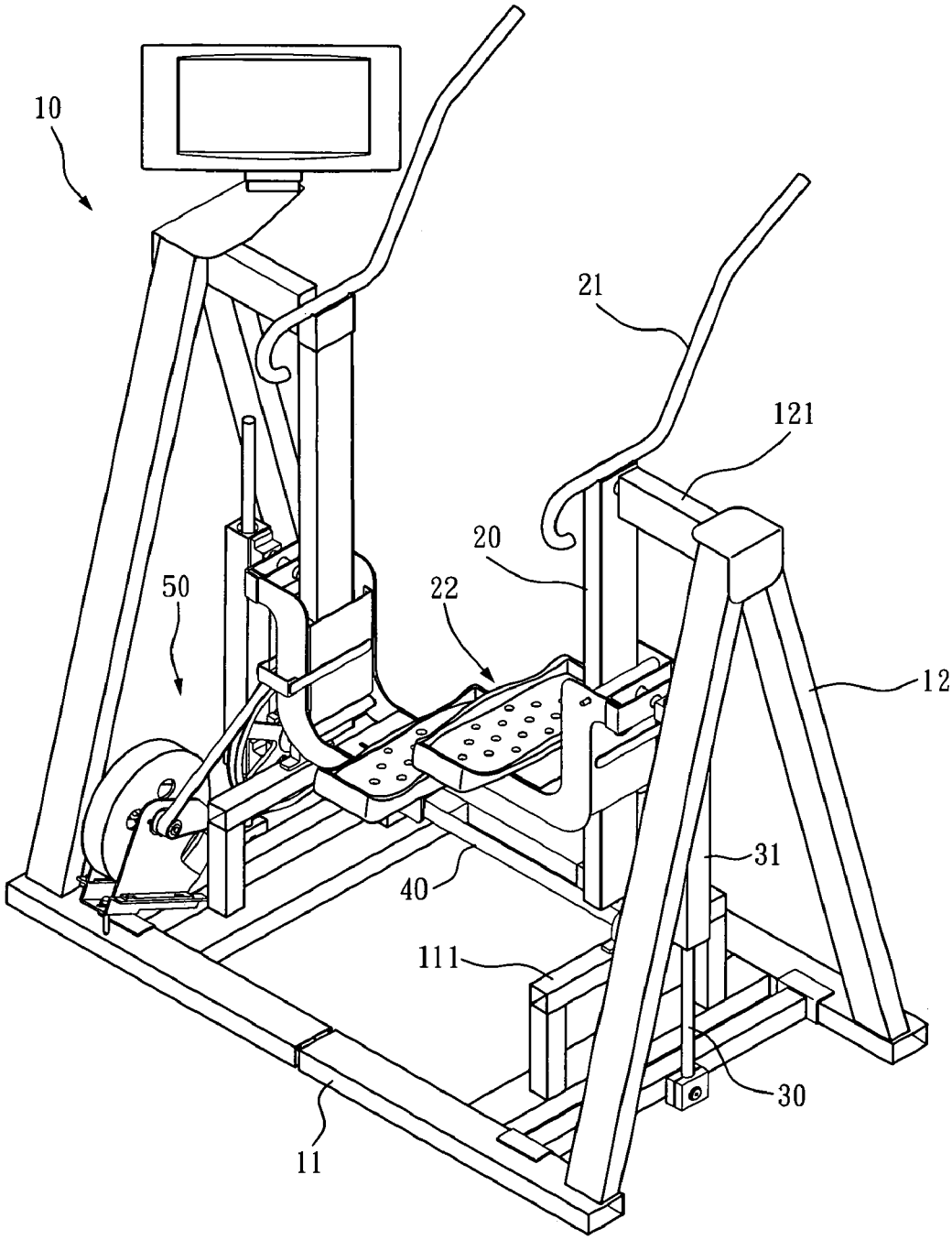
FIG. 1 is a perspective view of an elliptical exercise apparatus of the present invention.
Figure 2:
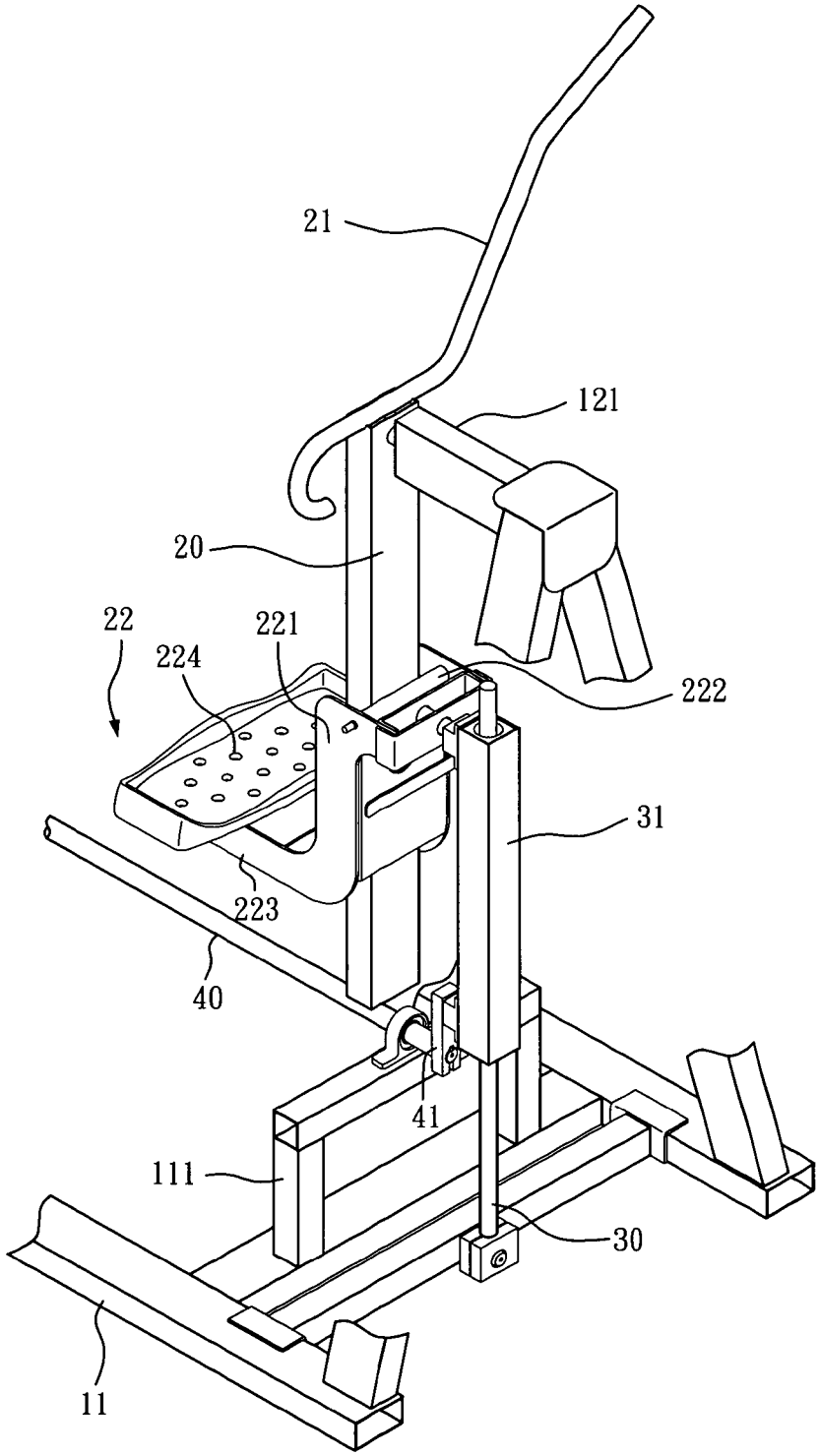
FIG. 2 is a partial perspective view of the elliptical exercise apparatus of FIG. 1.
Figure 3:
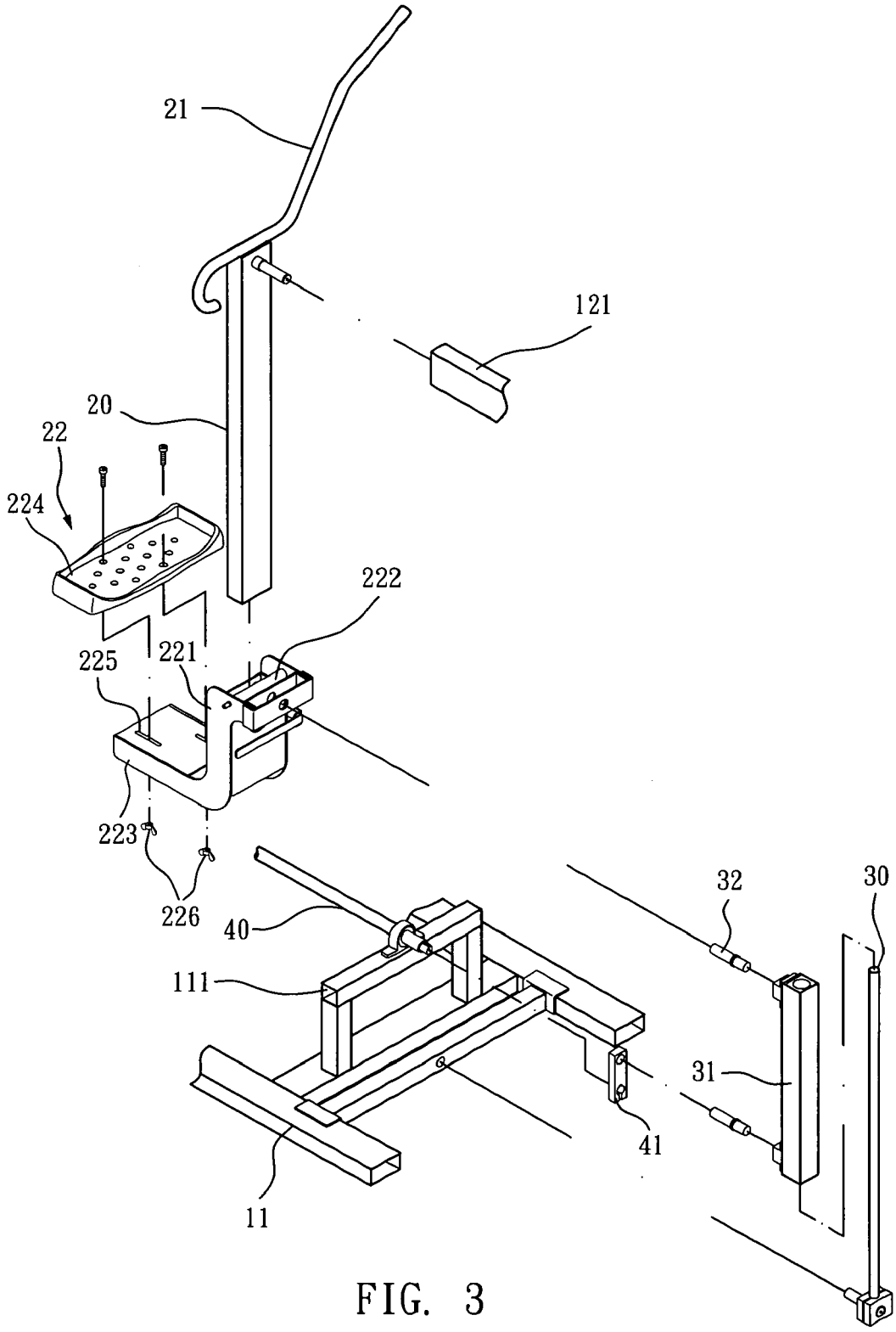
FIG. 3 is an exploded view of FIG. 2.
Figure 4:
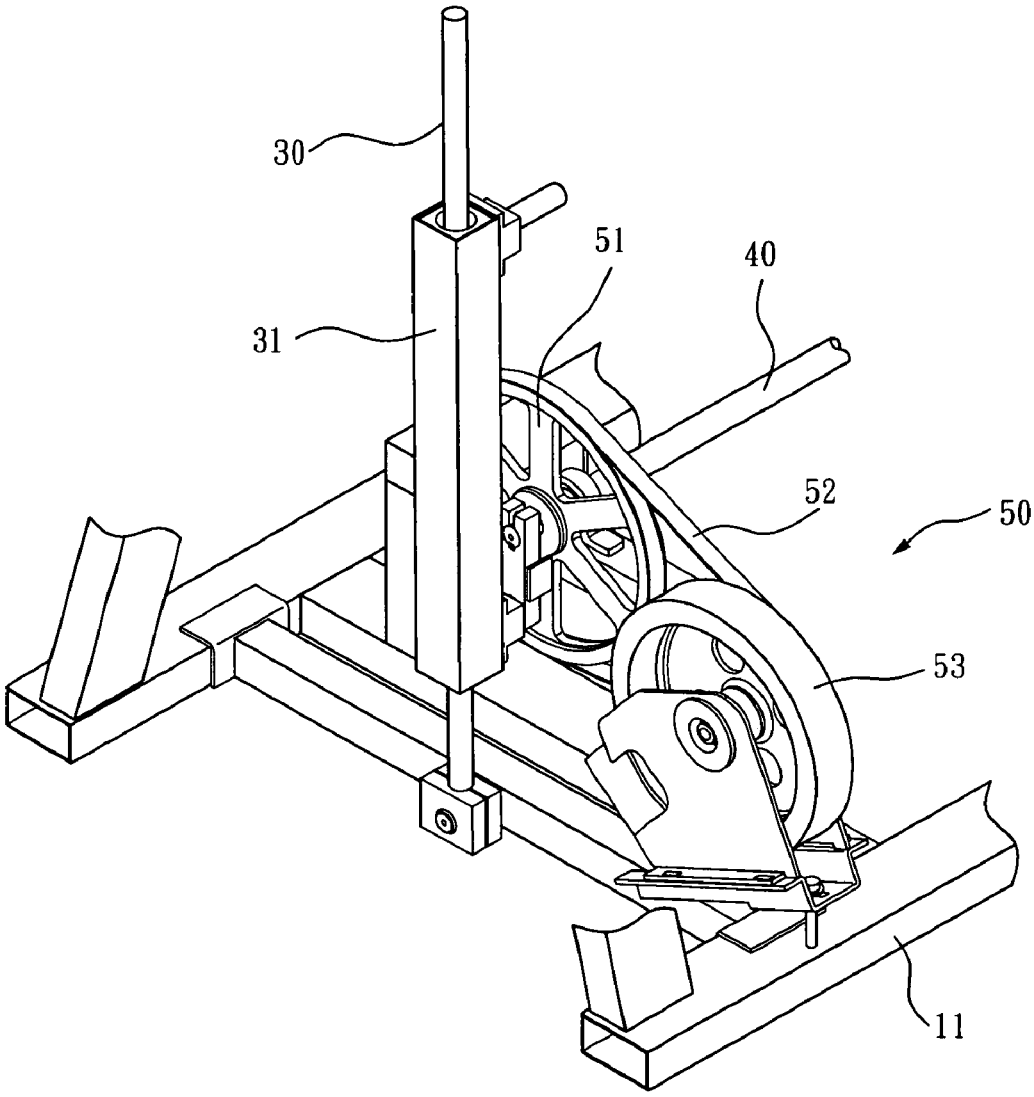
FIG. 4 is a perspective view of a resistance-adjusting device of the elliptical exercise apparatus of FIG. 1.
Figure 5:
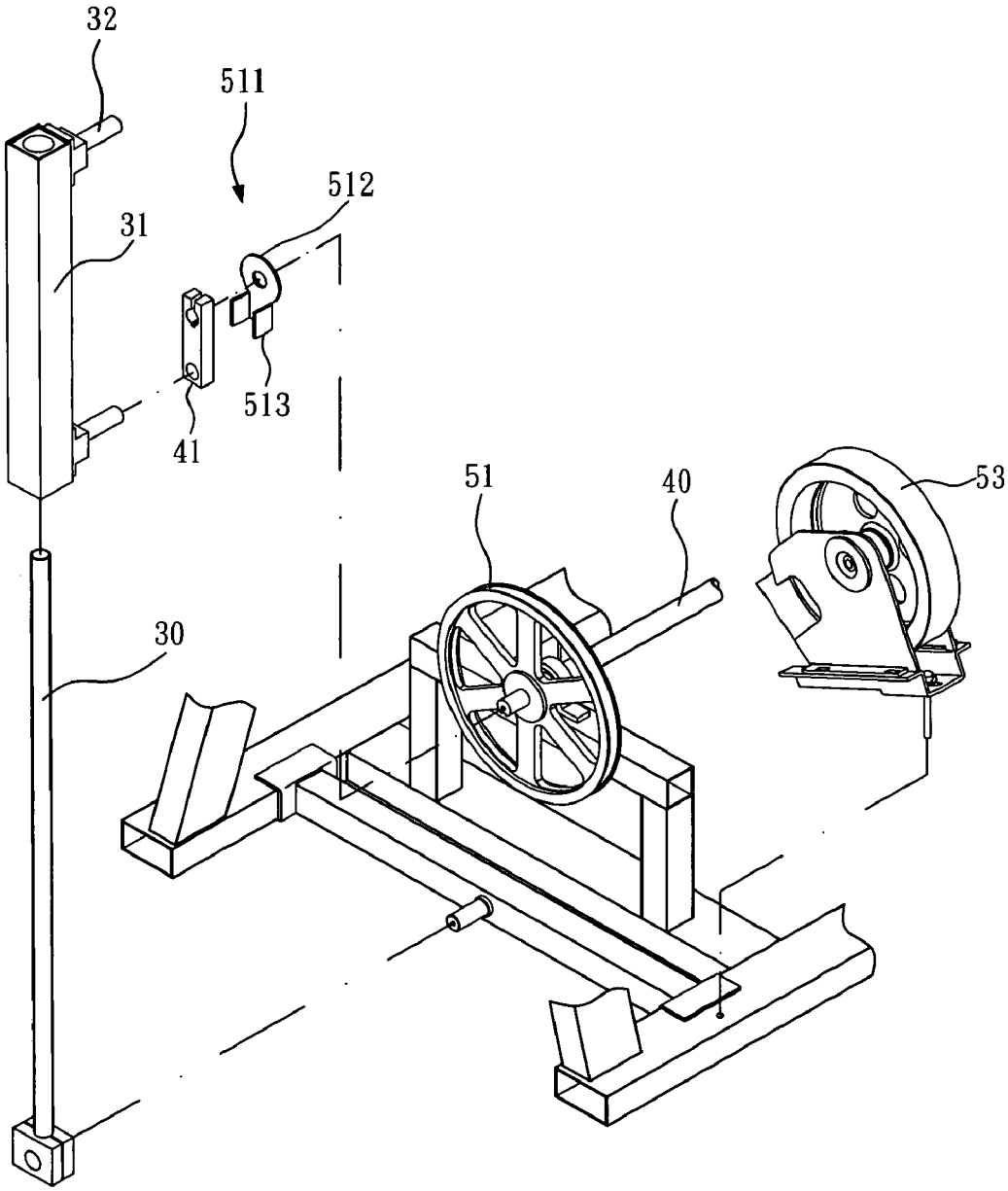
FIG. 5 is an exploded view of the resistance-adjusting device of FIG. 4.

While a preferred embodiment provided hereinafter for illustrating the concept of the present invention as described above, it is to be understood that the components of the embodiment shown in the accompanying drawings are depicted for the sake of easy explanation and need not to be made in scale.

Please refer to FIGS. 1 through 5 for an elliptical exercise apparatus disclosed in the present invention. The elliptical exercise apparatus primarily includes a body 10, a pair of lead swing arms 20, a pair of subsidiary swing arms 30, a rotational shaft 40, and a resistance-adjusting device 50.

The body 10 has a base frame 11 and two supporting frames 12 uprighted at two opposite sides of the base frame 11. Each of the supporting frames 12 has a cantilever beam 121 transversely overhanging the base frame 11. In addition, a pair of subsidiary supporting frames 111 raised from the base frame 11 are flanked by the supporting frames 12.

Each of the lead swing arms 20 has an upper end pivotally coupled with the corresponding supporting frame 12 through a joint so that the lead swing arm 20 can pivot on the joint. A handle portion 21 extends from the upper end of the lead swing arm 20 for an exerciser to hold. Therein a sliding treadle assembly 22 has a hollow sleeve portion 221 slidably mounted around a respective said lead swing arm 20. Each said hollow sleeve portion 221 contains therein a plurality of rollers 222. The rollers 222 abut upon the surface of the lead swing arm 20 for helping the hollow sleeve portion 221 to smoothly slide along the lead swing arm 20. A lower end of the hollow sleeve portion 221 extends transversely inward as a treadle-supporting segment 223 for supporting a treadle portion 224. Furthermore, the treadle-supporting segment 223 is formed with a plurality of slots 225 for allowing a plurality of adjusting screws 226 to pierce therethrough so as to fasten the treadle portion 224 to the treadle-supporting segment 223. In addition, since the slots 225 extend transversely, the design allows an exerciser to adjust the relative position between the treadle-supporting segment 223 and the treadle portion 224 according to his/her physical conditions by changing the position of the adjusting screws 226 in the slots 225.

Each of the subsidiary swing arms 30 has one end pivotally coupled with the base frame 11 between the corresponding supporting frame 12 and lead swing arm 20. A subsidiary sliding sleeve 31, as a hollow rod, is slidably mounted around the subsidiary swing arm 30. Therein, the subsidiary sliding sleeve 31 has an upper end pivotally coupled with the sliding treadle assembly 22 via a pivot 32.

The rotational shaft 40 has two ends pivotally coupled with the subsidiary supporting frames 111 so as to be posed over the base frame 11 in a transverse and rotatable manner with respect to the base frame 11. At each of the two ends of the rotational shaft 40, a rotational link 41 is vertically coupled. The rotational link 41 can drive the rotational shaft 40 to rotate and has an end far from the rotational shaft 40 pivotally coupled with a lower end of the subsidiary sliding sleeve 31. In virtue of the subsidiary supporting frames 111, even upon arriving at the lowest level along their rotational track, joints between the rotational links 41 and the subsidiary sliding sleeves 31 still remain higher than the joints between the subsidiary swing arms 30 and the base frame 11. Therein, the rotational links 41 at the opposite ends of the rotational shaft 40 are posed to extend in opposite directions.

The resistance-adjusting device 50 has a wheel 51 coupled with and rotating with the rotational shaft 40. The wheel 51 is further coupled with a damper 53 via a belt 52, which damper 53 serves to adjust a rotational resistance. Therein, the wheel 51 is laterally provided with a retainer 511. The retainer 511 includes a pivot portion 512 pierced by the rotational shaft 40 so that the pivot portion 512 is fixed to the wheel 51 and thus sandwiched between the wheel 51 and the corresponding rotational link 41. Moreover, the retainer 511 flanks the rotational link 41 with two wings 513 so as to rotationally retain the rotational link 41 with respect to the wheel 51.

Figure 6:
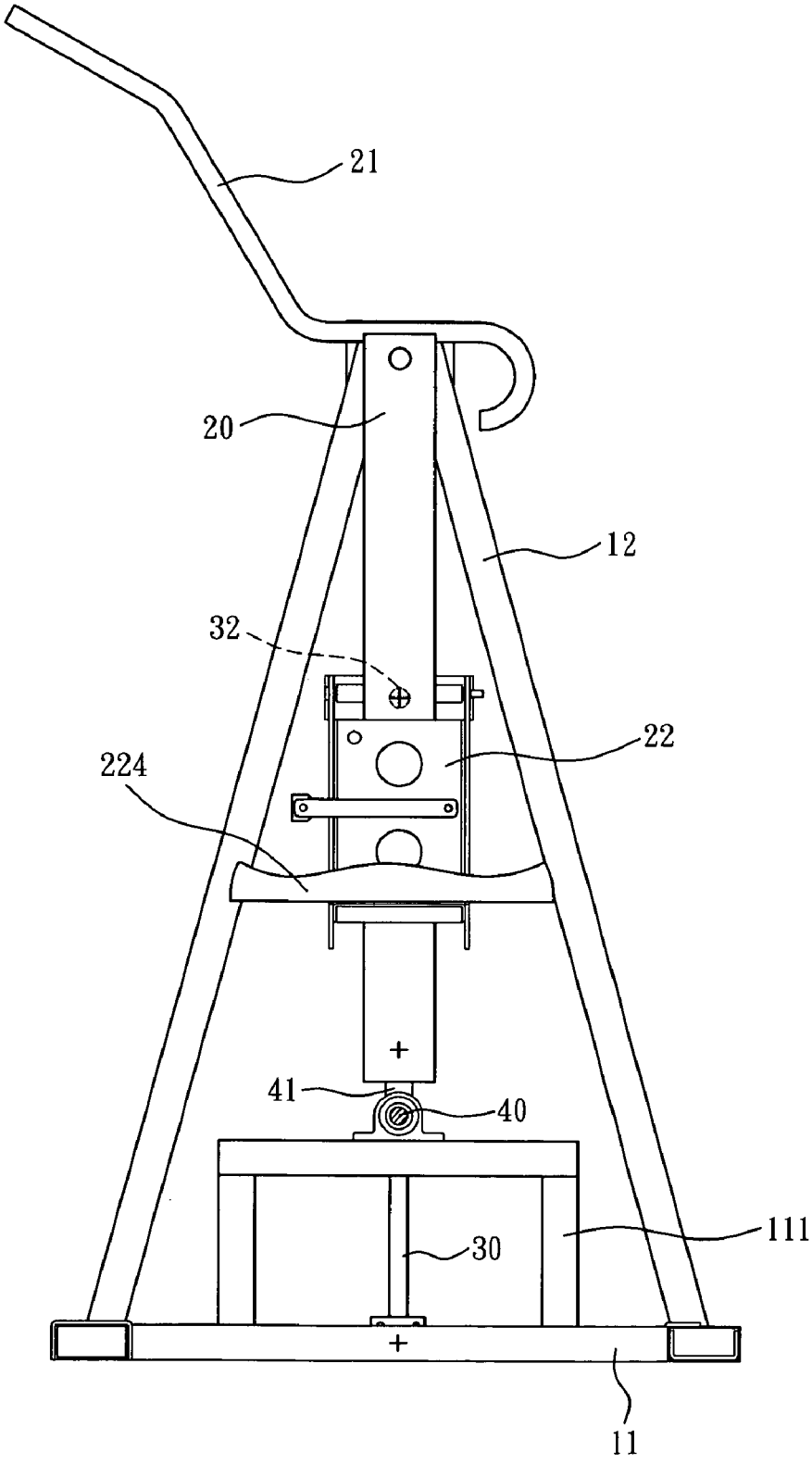
FIGS. 6 through 9 are schematic drawings showing operation of the elliptical exercise apparatus of the present invention.
Figure 7:
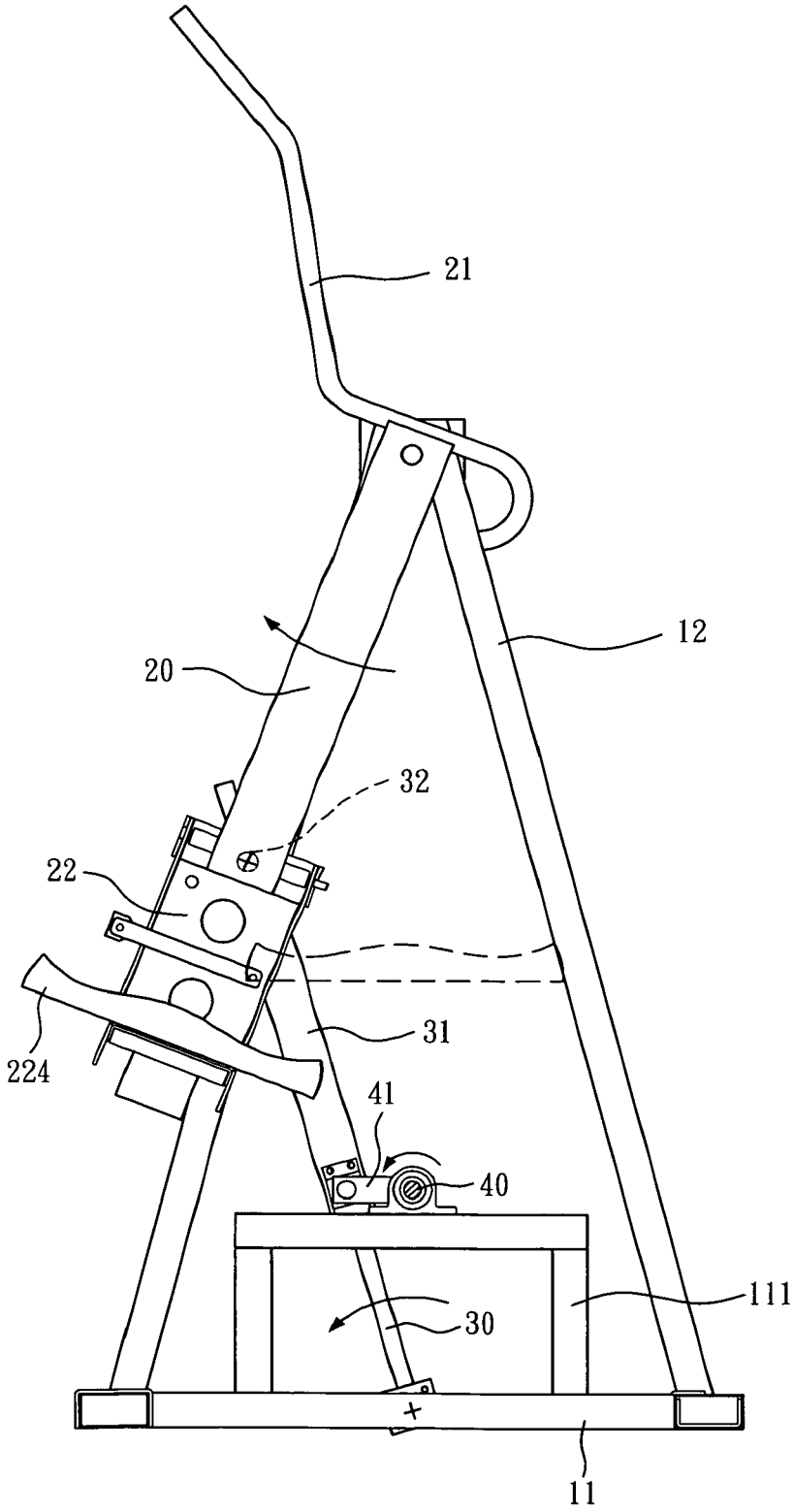

In FIGS. 6 through 9, the lateral views taken from middle toward the right side of the body 10 are provided for illustrating the operation of the elliptical exercise apparatus. As can be seen in FIG. 6, the treadle portion 224 is initially positioned at a highest point. When and exerciser's right foot pushes the treadle portion 224 forward and downward and the handle portion 21 is pulled backward, the lead swing arm 20 correspondingly swings forward and the sliding treadle assembly 22 slides axially along the lead swing arm 20 to move toward the lower end of the lead swing arm 20. Consequently, the subsidiary swing arm 30 swings forward due to the linkage between the subsidiary sliding sleeve 31 and the sliding treadle assembly 22. Meantime, the subsidiary sliding sleeve 31 slides axially along the subsidiary swing arm 30 to move toward the lower end of the subsidiary swing arm 30. As a result, the rotational link 41 is driven to rotate in the anti-clockwise direction, as shown in FIG. 7, heading to its lower front. Thereby, the exerciser's right foot is led to take a forward stride.

Figure 8:
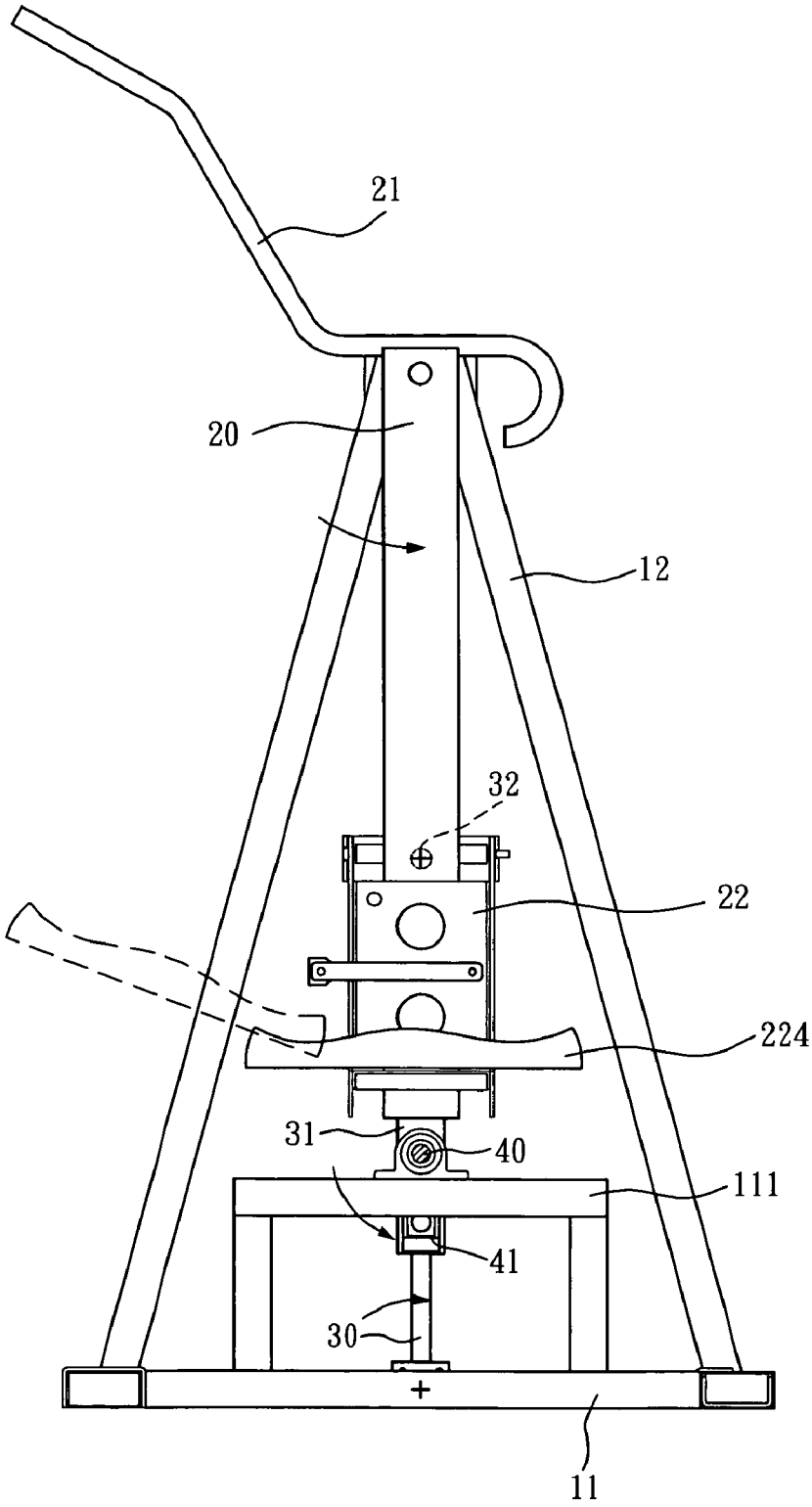

Referring to FIG. 8, when the treadle portion 224 at its headmost position, the exerciser pushes the treadle portion 224 backward and downward, and pushes the handle portion 21 forward. In response to the operation, the lead swing arm 20 and the subsidiary swing arms 30 swing backward and the rotational link 41 rotates to its lower rear so that the sliding treadle assembly 22 and the subsidiary sliding sleeve 31 slide toward the lower ends of the lead swing arm 20 and the subsidiary swing arms 30, respectively, leading the treadle portion 224 to swing backward and downward.

Figure 9:
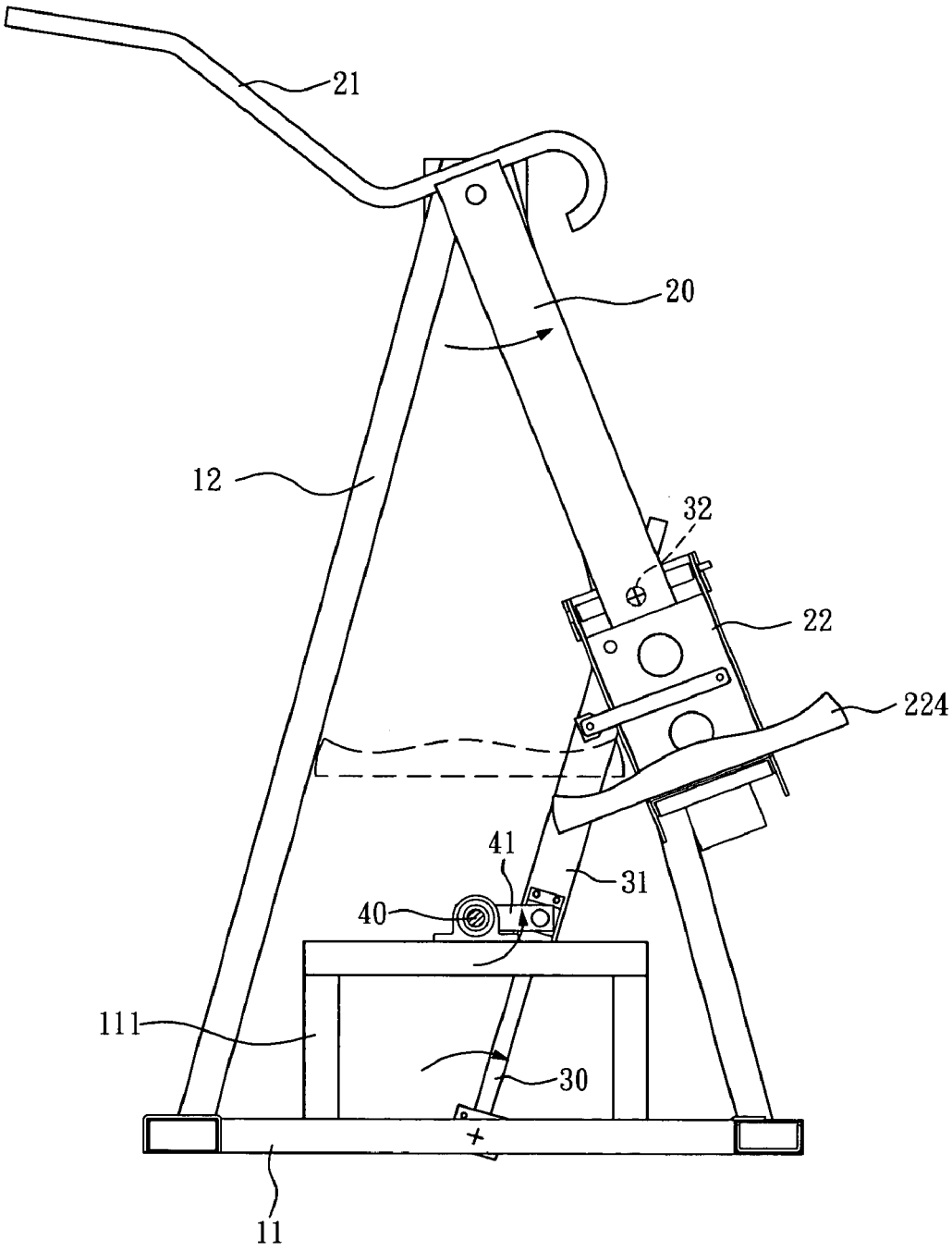

Referring to FIG. 9, after the treadle portion 224 arrives at its lowest position, the lead swing arm 20 and the subsidiary swing arms 30 swing backward and the rotational link 41 rotates toward its upper rear. As a result, the treadle assembly 22 and the subsidiary sliding sleeve 31 slide toward the upper ends of the lead swing arm 20 and the subsidiary swing arms 30, respectively, leading the treadle portion 224 to swing backward and upward. Consequently, the exerciser's foot thereon performs a backward swing.

After the treadle portion 224 arrives at its endmost position, the lead swing arm 20 and the subsidiary swing arms 30 swing forward again the rotational link 41 rotates toward its upper front. As a result, the treadle assembly 22 and the subsidiary sliding sleeve 31 slide toward the upper ends of the lead swing arm 20 and the subsidiary swing arm 30, respectively, leading the treadle portion 224 to swing upward and return to the initial position as shown in FIG. 6. Consequently, the exerciser's foot thereon performs a forward stride.

By the linkage among the lead swing arm 20, the subsidiary swing arm 30, the treadle assembly 22, the subsidiary sliding sleeve 31, the rotational shaft 40, and the rotational link 41, the treadle portion 224 generates an elliptical or elliptical-like exercise track. Thereby, the elliptical exercise apparatus can accurately simulate human striding and can provide improved exercise effects by facilitating increasing lower-limb muscles that get trained.

Besides, since the rotational links 41 at the opposite ends of the rotational shaft 40 are posed to extend in opposite directions, it is ensured that the exerciser's two feet are led to move in opposite directions at the same time so as to prevent the exerciser's two feet from simultaneously moving forward or backward and prevent the exerciser from exercising with only one foot due to the exerciser's poor coordination. Moreover, the rotational shaft 40 links the two sides of the elliptical exercise apparatus in a kinetic manner. Thus, when one of the exerciser's feet steps downward, the rotational shaft 40 transmits and coverts the downward force to the treadle portion 224 corresponding to the exerciser's the other foot as an upward force, so as to facilitate a smooth and continuous striding exercise.

Also, when the rotational shaft 40 rotates, the wheel 51 that is coupled with the damper 53 via the belt 52 is driven to rotate. The increase of resistance at the damper 53 gives an increased resistance to the rotational shaft 40, requiring the exerciser to push the treadle portions 224 with more strength. Thus, by adjusting the resistance provided by the damper 53, the elliptical exercise apparatus can be adjusted to present a variable exercise level to the exerciser.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An elliptical exercise apparatus, comprising:

a body having a base frame and two supporting frames uprighted at two opposite sides of the base frame;

a pair of lead swing arms each having an upper end pivotally coupled with the corresponding supporting frame, wherein a sliding treadle assembly having a lower end provided with a treadle portion is axially slidably attached to the lead swing arm;

a pair of subsidiary swing arms each having one end pivotally coupled with the base frame wherein a subsidiary sliding sleeve pivotally coupled with the sliding treadle assembly via a pivot is axially slidably attached to the subsidiary swing arm; and a rotational shaft transversely and pivotally coupled with the base frame, wherein at each of two ends of the rotational shaft, a vertical rotational link has one end coupled with the rotational shaft and an opposite end pivotally coupled with a lower end of the sliding sleeve;

whereby when the treadle portions are pushed, the lead swing arms and the subsidiary swing arms respectively swing back and forth and the sliding sleeves as well as the subsidiary swing arms slide vertically along the lead swing arms and the subsidiary swing arms while the rotational link rotates against the rotational shaft, leading the treadle portions to move along an elliptical exercise track.

2. The elliptical exercise apparatus of claim 1, wherein a handle portion extends from the upper end of each said lead swing arm.

3. The elliptical exercise apparatus of claim 1, wherein the sliding treadle assembly has a hollow sleeve portion and the sleeve portion includes a plurality of rollers abutting upon a surface of the lead swing arm.

4. The elliptical exercise apparatus of claim 3, wherein a lower end of each said hollow sleeve portion extends transversely inward as a treadle-supporting segment for supporting a respective said treadle portion.

5. The elliptical exercise apparatus of claim 1, wherein the subsidiary sliding sleeve is a hollow rod mounted around the subsidiary swing arm.

6. The elliptical exercise apparatus of claim 1, wherein the rotational shaft is pivotally supported by a pair of subsidiary supporting frames raised from the base frame.

7. The elliptical exercise apparatus of claim 1, wherein the rotational links at the opposite ends of the rotational shaft are posed to extend in opposite directions.

8. The elliptical exercise apparatus of claim 1, further comprising a resistance-adjusting device, which has a wheel coupled and rotating with the rotational shaft and is coupled with a damper via a belt, wherein the damper serves to adjust a rotational resistance for being provided to the wheel and in turn to the rotational shaft.

9. The elliptical exercise apparatus of claim 8, wherein the rotational link adjacent to the wheel is radially fixed to the wheel.

10. The elliptical exercise apparatus of claim 9, wherein the wheel and the rotational link are fixedly connected with a retainer settled therebetween.

11. The elliptical exercise apparatus of claim 10, wherein the retainer includes a pivot portion, which is pierced by the rotational shaft and fixed to the wheel, and the retainer flanks the rotational link with two wings.

12. The elliptical exercise apparatus of claim 1, wherein each said treadle-supporting segment is formed with a plurality of slots for allowing a plurality of adjusting screws to pierce therethrough and fasten the treadle portion to the treadle-supporting segment.

* * * * *